United States Patent [19]

Siegwart et al.

[11] 4,065,098

[45] Dec. 27, 1977

[54] WEDGE PUSH-IN APPARATUS FOR A WIRE TENSIONING PRESS

[75] Inventors: Hans-Rudolf Siegwart, Kilchberg; René Käser, Wettingen, both of Switzerland

[73] Assignee: Bureau BBR Ltd., Zurich, Switzerland

[21] Appl. No.: 807,294

[22] Filed: June 16, 1977

[30] Foreign Application Priority Data

July 2, 1976 Switzerland ..... 8512/76

[51] Int. Cl.[2] ..... E21B 19/00

[52] U.S. Cl. ..... 254/29 A

[58] Field of Search ..... 254/29 A; 29/452

[56] References Cited

U.S. PATENT DOCUMENTS 3,597,830 8/1971 Yegge ..... 254/29 A 3,610,581 10/1971 Paul ..... 254/29 A 3,844,023 10/1974 Surribas et al. ..... 254/29 A

*Primary Examiner*—Robert C. Watson

[57] ABSTRACT

A wedge push-in apparatus for a tensioning press for a bundle of wires, wherein the individual wires are intended to be anchored by means of wedges in an anchoring head. In order to push-in the wedges there is provided a wedge push-in plate which can be actuated by means of lengthwise displaceable push-in elements which engage at the wedge push-in plate. The push-in elements are arranged at a common, lengthwise displaceable support in such a manner that, with the support located in its starting position, the push-in elements do not protrude into the interior of the apparatus. Means are provided in order to bring the push-in elements into their work position for the purpose of actuating the wedge push-in plate.

10 Claims, 4 Drawing Figures

WEDGE PUSH-IN APPARATUS FOR A WIRE TENSIONING PRESS

BACKGROUND OF THE INVENTION

The present invention relates to a new and improved construction of a wedge push-in apparatus for a tensioning press or prestressing jack for a bundle of wires, wherein the wires thereof are intended to be anchored by means of wedges in an anchoring head, and for pushing-in the wedges there is provided a wedge push-in plate which can be actuated by means of lengthwise displaceable push-in elements which engage at the wedge push-in plate.

Wedge push-in apparatuses of the previously mentioned type are usually directly connected with the front end of the hydraulic tensioning press and form a unit with such press.

For the tensioning of the bundle of wires, protruding out of the concrete structure, the anchoring head together with its anchoring parts and the displaceable wedge push-in plate which is provisionally fixed in place by means of the wedges as well as a tensioning head with the tensioning wedges, are attached to the bundle of wires.

The tensioning press together with the wedge push-in apparatus are shoved by means of its anchoring parts onto the ends of the bundle of wires, and the tensioning head passes through the central opening of the tensioning- and push-in apparatus.

It is further to be mentioned that the push-in apparatus is equipped with an impact or stop flange at the inside, this stop flange serving to guide the anchoring head and to press such against the anchoring plate.

In order to actuate the wedge push-in plate there are provided push-in elements. Since these elements, on the one hand, must enable pushing through or insertion of the tensioning head, and, on the other hand, must engage over the wedge push-in plate, in order to actuate such plate for the purpose of anchoring the previously stressed or tensioned wires, the anchoring head must possess an undesirably large external diameter.

SUMMARY OF THE INVENTION

Hence, with the foregoing in mind it is a primary object of the present invention to provide an improved construction of wedge push-in apparatus for wire tensioning presses which is not associated with the aforementioned drawbacks and limitations of the prior art constructions.

Yet a further significant object of the present invention aims at the provision of a new and improved construction of wedge push-in apparatus for a wire tensioning press, which apparatus is relatively simple in construction and design, relatively easy to use, economical to manufacture, highly reliable in operation, not readily subject to breakdown or malfunction, and requires a minimum of maintenance and servicing.

Another significant object of this invention aims at the provision of a new and improved construction of wedge push-in apparatus which is designed such that there are not required undesired large external diameters of the anchoring head, and further affords reliable pushing-in of the wedges into the anchoring head for the purpose of securely anchoring the wires of a bundle of wires therein.

Now in order to implement these and still further objects of the invention, which will become more readily apparent as the description proceeds, the wedge push-in apparatus of the present development, and possessing the basic structure indicated at the outset of this disclosure, is manifested by the features that the push-in elements for the wedge plate are arranged at a common, lengthwise displaceable support in such a manner that, with the support located in its starting position, these push-in elements do not protrude into the interior of the apparatus, and means are provided in order to bring the push-in elements into their work position for the purpose of actuating the wedge push-in plate.

Hence, the previously mentioned problem can thus be satisfactorily solved, since the push-in elements are structured to be movable transversely with respect to the lengthwise axis of the anchoring head. Upon pushing through the tensioning head the push-in elements are located in their open position. During pushing-in of the wedges the push-in elements advantageously automatically move into their closed effective or operative position and engage over the wedge push-in plate.

It is advantageous to arrange the aforementioned push-in elements at the support so as to be retractable and extendable, respectively. According to a particularly advantageous constructional embodiment the push-in elements are pivotably arranged at the support about an axis disposed transversely with respect to the displacement direction of the wedge push-in apparatus. According to an extremely advantageous constructional manifestation of the invention, where the support, when not actuated, automatically returns or is retained in its starting position, stop means are provided which automatically bring the push-in elements out of their work position or retain such out of their work position, when the support is located in its starting position. Furthermore, spring elements are beneficially provided in order to automatically rock the push-in elements into their work position when the support or support means moves out of the starting position, and stop means are provided which limit such pivotal or rocking movement. It is especially preferred to construct the push-in elements in the form of pivotal arms, and the end of each arm neighboring the pivot axis abuts against a stop when the support moves into the starting position, in order to rock the arms out of the work or operative position.

The aforementioned support for the push-in elements is advantageously constructed as a ring or in the form of a sleeve-like collar, respectively, surrounding the body of the apparatus, and which ring or collar can be shifted by means of hydraulic presses or equivalent structure. The return of the support or support means into its starting position is accomplished advantageously with the aid of springs when the hydraulic presses are not under load.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE INVENTION

Figure 1:
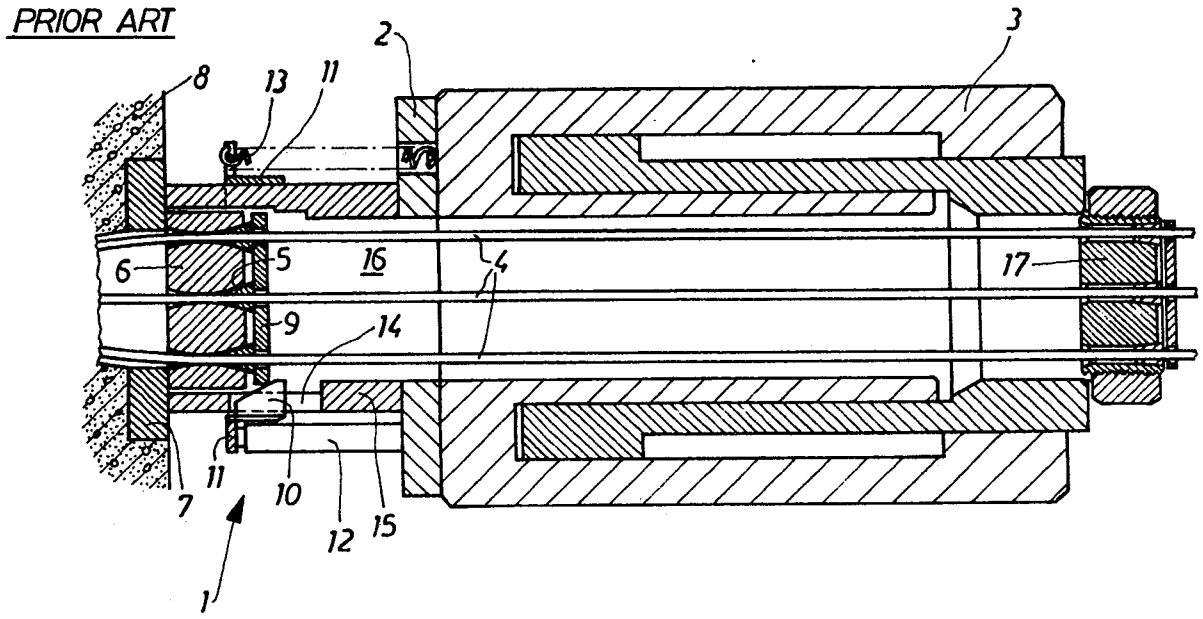
Fig. 1 PRIOR ART
FIG. 1 schematically illustrates a press equipped with a wedge push-in apparatus of the prior art.

Describing now the drawings, in FIG. 1 there is illustrated a prior art wedge push-in apparatus 1 which is connected by means of a flange 2 with the actual wire tensioning press 3.

The individual wires 4 of the bundle of wires are anchored by means of wedges 5 in an anchoring head 6 which bears against an anchoring plate 7 mounted in the concrete structure 8. This state-of-the-art wedge push-in apparatus 1 is equipped with a wedge push-in plate 9 which can be displaced against the wedges 5, following tensioning or stressing of the wires 4, by means of fixed, lengthwise displaceable push-in or clamping elements 10, in order to simultaneously place the wedges 5 in their clamping position. The push-in or clamping elements 10 are arranged at a ring 11 which can be axially shifted or displaced by means of hydraulic presses 12. The push-in elements 10 can be again returned back into their starting position by means of tension springs 13 which engage at one end at the flange 2 and at the other end at the ring 11. The push-in elements 10 arranged at the ring 11 — there being provided at least two such push-in elements 10 at the periphery of such ring 11 — extend inwardly over the wedge push-in plate 9 through slots 14 provided at the actual body or body member 15 of the push-in apparatus.

The free inner space 16 of the apparatus and the press must be dimensioned, as regards the diameter thereof, such that the auxiliary anchoring head 17 can be guided through such inner space 16.

Figure 2:
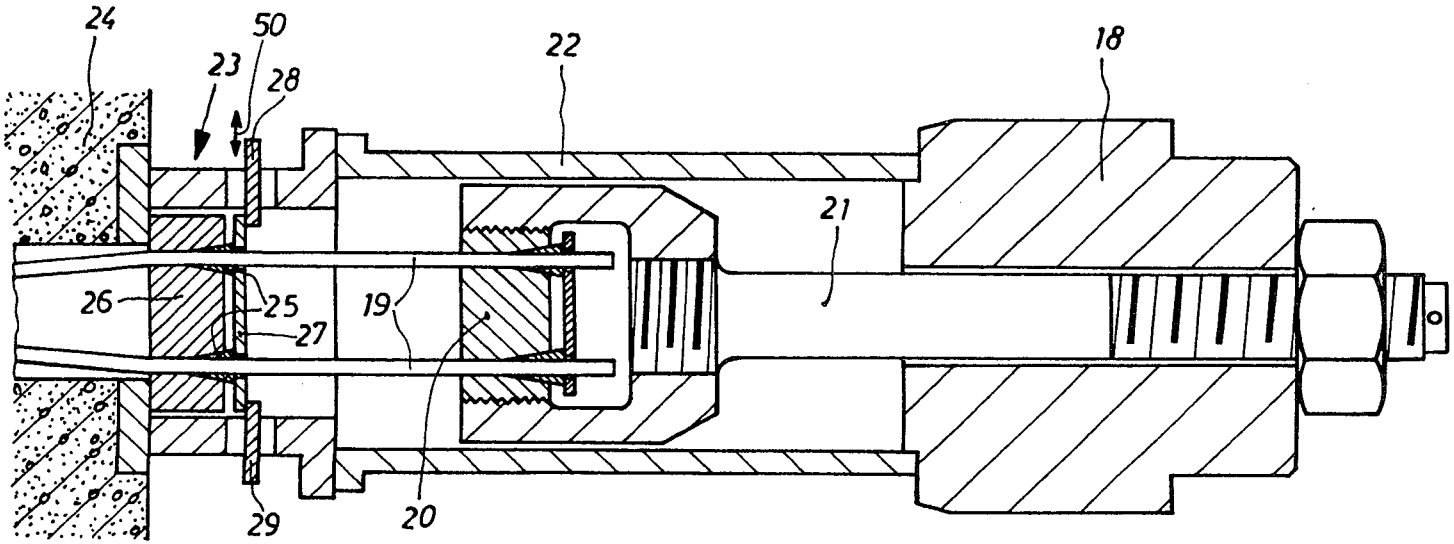
FIG. 2 is a longitudinal sectional view through another type of a tensioning press equipped with a wedge push-in apparatus and constructed according to the present invention.

Now in FIG. 2 of the drawing there is schematically illustrated an embodiment of tensioning press 18 constructed as a spindle press and employing teachings of the present invention. The wires 19 of the bundle of wires which are to be tensioned are stressed in a tensioning head 20 at the end of a spindle 21 which is actuated by the tensioning press 18. This tension press 18 is supported by means of a supporting frame or stand 22 and a wedge push-in apparatus 23 at the concrete structure 24. The tensioned or prestressed wires 19 are anchored conventionally by means of wedges 25 in an anchoring head 26. In order to push-in the wedges 25 at the proper moment in time, i.e. before or during reduction of the tensioning force, there is provided a wedge push-in or press-in plate 27. This push-in plate 27, in turn, is actuated by means of wedge push-in elements 28 and 29 provided at a common support or carrier, like the sleeve-shaped ring or collar 35 illustrated for the embodiment of FIG. 3, and such wedge push-in elements 28 and 29 extend inwardly over the push-in plate 27 and laterally through the body of the wedge push-in apparatus 23. The push-in elements 28 and 29 can be displaced by any suitable means, such as hydraulic presses e.g. piston and cylinder units, which have not been here particularly shown but may be like the hydraulic presses 42, 43 provided for the arrangement of FIGS. 3 and 4. In order to maintain the inner space of the apparatus free from any superfluous protruding parts, the push-in elements 28 and 29 are mounted to be displaceable, as generally indicated by the double-headed arrow 50 of FIG. 2. In particular, the push-in elements 28 and 29 may be mounted to be pivotable or shiftable in any convenient fashion, and specifically, in such a manner that during non-use of the equipment, i.e. with the support located in its starting position, these push-in elements 28 and 29 do not protrude into the inner space of the apparatus, whereas, when necessary such push-in elements can be displaced into their work or operative position for the purpose of actuating the wedge push-in plate 27.

Figure 3:
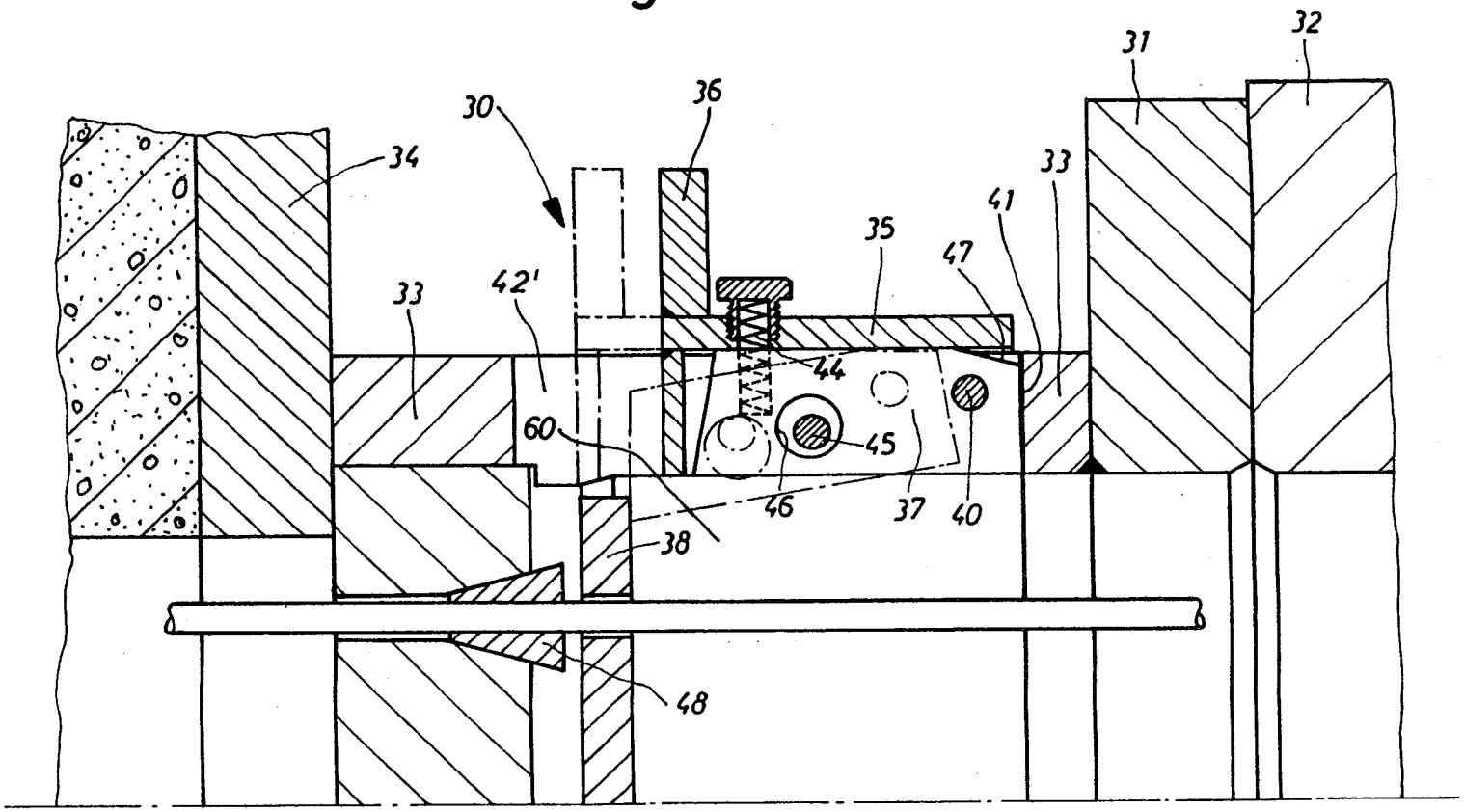
FIG. 3 is a longitudinal sectional view, taken to one side of the lengthwise axis of a wedge push-in apparatus constructed according to another embodiment of the present invention.
Figure 4:
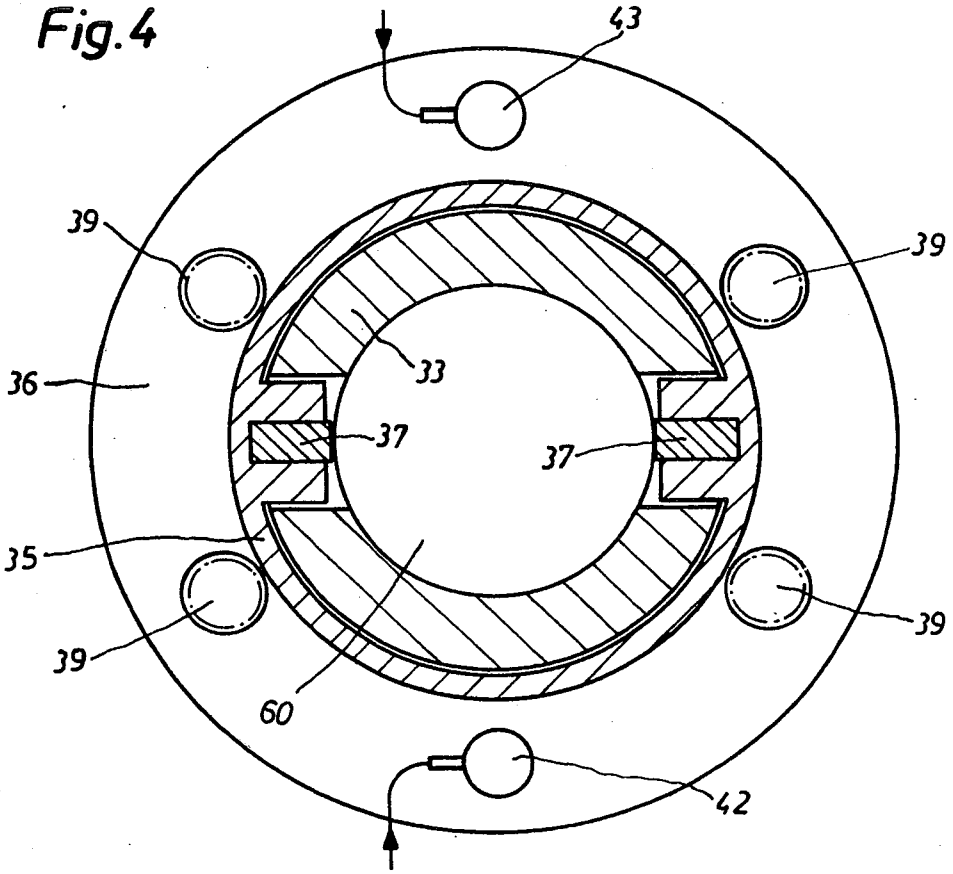
FIG. 4 is a schematic cross-sectional view through the apparatus structure shown in FIG. 3.

Continuing, in FIGS. 3 and 4 there is illustrated a further embodiment of wedge push-in apparatus constructed according to the teachings of the present invention and which enables smaller dimensioning of the actual anchoring head. By turning attention specifically to FIG. 3 there will be seen a section of a particularly advantageous constructional embodiment of wedge push-in apparatus 30 which here is likewise affixed by means of a flange 31 at a hydraulic tensioning press 32. The actual body 33 of the apparatus 30, also with this arrangement, bears by means of a plate 34 upon the concrete structure. A substantially sleeve-shaped ring or collar 35 equipped with a flange 36 forms the support means for the push-in elements 37 for a wedge push-in plate 38. This sleeve-shaped ring or ring member 35 is normally located in the illustrated starting position, i.e. it is retained in such starting position by means of the springs 39 (FIG. 4) or equivalent structure. In this position the push-in elements 37, mounted to be inwardly pivotable about an associated pivot shaft or axis 40, contact an upper stop edge 41 of an opening 42' provided in the apparatus body 33 and retain the push-in elements 37 in the illustrated position. In other words: these push-in elements 37 do not extend into the inner space 60 of the apparatus 30 and thus are not dispositioned over the wedge push-in plate 38. In the embodiment under discussion each of the push-in elements is constructed as a pivotable or pivotal arm, and as explained above, the end of each such arm which neighbors the related pivot shaft 40, with the movable support means 35, 36 located in the illustrated starting position of FIG. 3, abuts against a stop, here in the form of the afore-mentioned stop edge 41, in order to rock each such pivotal arm out of its working or operable position where such push-in elements 37 are located over the push-in plate 38. These push-in elements 37, of which only one of two diametrically oppositely situated push-in elements 37 has been shown in FIG. 3 to simplify the drawing illustration, can be displaced together with the ring 35 in the direction of the wedge push-in plate 38 by means of hydraulic presses 42 and 43 or equivalent structure which engage between the flanges 31 and 36. As soon as the ring or ring member 35 together with the push-in elements 37 has moved in the direction of the push-in plate 38, then each push-in element 37 is pressed by means of a spring 44 automatically into its working or operable position, i.e. into the interior or inner space 60 of the apparatus. A stop or impact pin 45, guided through a bore 46 of the associated push-in element 37, ensures that each such push-in element 37 will not be rocked to an unnecessary extent. A further stop or impact means is formed by the bevelled portion 47 provided at the rear edge of the associated push-in element 37.

As soon as during displacement of the push-in elements 37 and the ring 35, the push-in plate 38 has brought the wedges 48 into their clamping position, then the hydraulic presses 42 and 43 can be again relieved of their hydraulic loading or vented and the ring 35 together with the push-in elements 37 is returned by the springs 39 back into the starting position shown in FIG. 3. With such movement there simultaneously and automatically occurs a pivoting-back of the push-in elements 37 into their starting or rest position. In FIG. 3 there is shown in broken or phantom lines the position of the illustrated push-in element 37, in which position such element protrudes into the inner space 60 of the body 33 of the apparatus 30 and thus extends over the wedge push-in plate 38.

Now for a proper depression of the push-in plate 38 it is necessary that there be provided at least two diametrically oppositely situated push-in elements. Of course, it would be possible to provide also a greater number of such push-in elements, for instance, three push-in elements arranged at a uniform spacing about the periphery of the apparatus body.

Finally, FIG. 4 of the drawing illustrates a horizontal section through the push-in apparatus shown in FIG. 3, purely schematically, there being predominately illustrated the hydraulic presses 42 and 43, the return springs 39 and also the two diametrically oppositely situated push-in elements 37.

While there are shown and described present preferred embodiments of the invention, it is to be distinctly understood that the invention is not limited thereto, but may be otherwise variously embodied and practiced within the scope of the following claims.

Accordingly we claim:

1. In a wedge press-in apparatus for a tensioning press for tensioning a bundle of wires, the individual wires of which can be anchored by means of wedges in an anchoring head, a wedge push-in plate serving to push-in the wedges, the improvement which comprises:

push-in elements for actuating the wedge push-in plate;

means providing a common, lengthwise displaceable support movable out of a starting position;

means mounting the push-in elements at said common, lengthwise displaceable support means for movement between a rest position and a work position;

said push-in elements being mounted at said support means such that with said support means in its starting position said push-in elements do not extend into the interior of the wedge push-in apparatus; and means for placement of the push-in elements into their work position for actuating the wedge push-in plate.

2. The improvement as defined in claim 1, wherein:

said mounting means incorporates structure for mounting the push-in elements at the support means so as to be retractable and extendable relative thereto.

3. The improvement as defined in claim 1, wherein:

said mounting means for the push-in elements incorporates means for pivotably mounting said push-in elements at said support means.

4. The improvement as defined in claim 3, further including:

means for automatically returning said support means back into its starting position when said wedge push-in apparatus is not actuated;

stop means for automatically bringing the push-in elements out of their work position and for retaining such out of said work position when said support means is located in its starting position.

5. The improvement as defined in claim 4, further including:

spring means for automatically pivoting the push-in elements into their work position when said support means is moved out of its starting position; and stop means for limiting the pivotal movement of said push-in elements.

6. The improvement as defined in claim 5, wherein:

each of said push-in elements is structured as a pivotal arm;

said mounting means for said push-in elements comprising a pivot shaft provided for each said pivotal arm;

stop means against which impacts the end of each arm neighboring its associated pivot shaft when said support means is moved into its starting position, in order to pivot said pivotal arms out of their work position.

7. The improvement as defined in claim 1, wherein:

said support means for said push-in elements comprises a ring member;

said wedge push-in apparatus including a body;

said ring member surrounding said apparatus body.

8. The improvement as defined in claim 1, further including:

means for hydraulically displacing said support means.

9. The improvement as defined in claim 1, further including:

hydraulic press means for displacing said support means out of its starting position; and spring means for returning said support means back into its starting position.

10. The improvement as defined in claim 1, wherein:

said push-in elements comprise two diametrically oppositely situated push-in elements.

* * * * *